US009171335B1

(12) United States Patent
Cierniak

(10) Patent No.: US 9,171,335 B1
(45) Date of Patent: Oct. 27, 2015

(54) PROVIDING SOCIAL GRAPH INFORMATION FOR A WEBPAGE

(75) Inventor: Michal Cierniak, Palo Alto, CA (US)

(73) Assignee: Google Inc., Mountain View, CA (US)

( * ) Notice: Subject to any disclaimer, the term of this patent is extended or adjusted under 35 U.S.C. 154(b) by 461 days.

(21) Appl. No.: 12/898,608

(22) Filed: Oct. 5, 2010

Related U.S. Application Data

(60) Provisional application No. 61/383,696, filed on Sep. 16, 2010.

(51) Int. Cl.
*G06Q 50/00* (2012.01)

(52) U.S. Cl.
CPC ..... *G06Q 50/01* (2013.01)

(58) Field of Classification Search
CPC ..... G06Q 50/01
USPC ..... 715/733; 705/319
See application file for complete search history.

(56) References Cited

U.S. PATENT DOCUMENTS

| | | | | |
|---|---|---|---|---|
| 7,069,308 | B2 * | 6/2006 | Abrams | 709/218 |
| 7,747,648 | B1 * | 6/2010 | Kraft et al. | 707/790 |
| 7,774,409 | B2 * | 8/2010 | Fitzpatrick et al. | 709/206 |
| 8,744,976 | B2 * | 6/2014 | Jagadish et al. | 705/319 |
| 2003/0036914 | A1 * | 2/2003 | Fitzpatrick et al. | 705/1 |
| 2005/0216300 | A1 * | 9/2005 | Appelman et al. | 705/1 |
| 2005/0216550 | A1 * | 9/2005 | Paseman et al. | 709/202 |
| 2006/0190536 | A1 * | 8/2006 | Strong et al. | 709/204 |
| 2010/0274815 | A1 * | 10/2010 | Vanasco | 707/798 |

OTHER PUBLICATIONS

Bilton, Nick, "Facebook's Killer Feature: The Mutual Friends List," Dec. 2, 2009, The New York Times, Available http://bits.blogs.nytimes.com/2009/12/02/facebooks-killer-feature-the-mutual-friends-list/?_r=0.*

Carta, Doriano, "How to Find Mutual Friends on Twitter," Dec. 4, 2009, Gigaom, Available https://gigaom.com/2009/12/04/how-to-find-mutual-friends-on-twitter/.*

Tsotsis, Alexia, "Twitter's 'Followed by' and 'You Both Follow' More Useful Than 'Mutual Friends'," Aug. 16, 2010, TechCrunch, Available http://techcrunch.com/2010/08/16/twitters-followed-by-you-both-follow-more-useful-than-mutual-friends/.*

Social Graph API Demo—Site Connectivity [online], [retrieved on Nov. 8, 2010]. Retrieved from the Internet: <http://socialgraph-resources.googlecode.com/svn/trunk/samples/findyours.html?q=>, 2 pages.

(Continued)

*Primary Examiner* — Alvin Tan
(74) *Attorney, Agent, or Firm* — Fish & Richardson P.C.

(57) ABSTRACT

Systems and techniques for displaying information associated with multiple accounts of multiple social media websites owned by an owner. In one implementation, a webpage accessed by a user can be determined to be a webpage of a social media website; data can be obtained from the webpage identifiable with an owner of an account of the social media website in which the owner of the account is not the user; based on the data from the accessed webpage identifiable with the owner, another social media webpage associated with another account of the owner for another social media website can be identified; data associated with the other social media webpage can be obtained; and the data associated with the other account can be provided for display with the accessed webpage.

16 Claims, 4 Drawing Sheets

(56) References Cited

OTHER PUBLICATIONS

Intersect—Google Chrome extension gallery [online], [retrieved on Oct. 5, 2010]. Retrieved from the Internet: <https://chrome.google.com/extensions/detail/npdjhmblakdjfnnajeomfbogokloiggg>, 2 pages.
Social Graph API—Google Code [online], [retrieved on Oct. 5, 2010]. Retrieved from the Internet: <http://code.google.com/apis/socialgraph/>, 3 pages.
About the Social Graph—Social Graph API—Google Code [online], [retrieved on Oct. 5, 2010]. Retrieved from the Internet: <http://code.google.com/apis/socialgraph/docs/>, 4 pages.
Edge Types—Social Graph API—Google Code [online], [retrieved on Oct. 5, 2010]. Retrieved from the Internet: <http:// code.google.com/apis/socialgraph/docs/edges.html>, 3 pages.
Attributes—Social Graph API—Google Code [online], [retrieved on Oct. 5, 2010]. Retrieved from the Internet: <http://code.google.com/apis/socialgraph/docs/attributes.html>, 1 page.
Canonical Node Representation—Social Graph API—Google Code [online], [retrieved on Oct. 5, 2010]. Retrieved from the Internet: <http://code.google.com/apis/socialgraph/docs/canonical.html>, 3 pages.
Social Graph API—My Connections [online], [retrieved on Nov. 8, 2011-08]. Retrieved from the Internet: <http://socialgraph-resources.googlecode.com/svn/trunk/samples/findcontacts.html>, 2 pages.
Frequently Asked Questions—Social Graph API—Google Code [online], [retrieved on Oct. 5, 2010]. Retrieved from the Internet: <http://code.google.com/apis/socialgraph/faq.html>, 4 pages.
Danah M. Boyd et al., "Social Network Sites: Definition, History and Scholarship," Journal of Computer-Mediated Communication, vol. 13, Issue 1, Oct. 2007, pp. 210-230.
Lada A. Adamic et al., "Social network caught in the Web," First Monday, vol. 8, No. 6, Jun. 2, 2003, 22 pages.
thebubba, "FAQ Question #163: How do I find a syndicated account?," LiveJournal, Jan. 6, 2004, 2 pages.
Nathan Eagle et al., "Social Serendipity: Proximity Sensing and Cueing," MIT Media Laboratory Technical Note 580, May 2004, 18 pages.
Junichiro Mori et al., "Real-world Oriented Information Sharing Using Social Networks," Proceedings of the 2005 International ACM SIGGROUP Conference on Supporting Group Work (Group 05), Nov. 6-9, 2005, pp. 81-84.
Alice Emily Marwick, "Selling Your Self: Online Identity in the Age of a Commodified Internet," Thesis for degree of Master of Arts, University of Washington, 2005, 192 pages.
Tracy Cohen et al., "Social Networks for Creative Collaboration," Proceedings of the 5th Conference on Creativity & Cognition (C&C'05), Apr. 12-15. 2005, London United Kingdom, pp. 252-255.
Jeffrey Heer et al., "Vizster: Visualizing Online Social Networks," IEEE Symposium on Information Visualization (INFOVIS 2005), Oct. 23-25, 2005, pp. 32-39.

* cited by examiner

PROVIDING SOCIAL GRAPH INFORMATION FOR A WEBPAGE

This application claims priority to and the benefit of U.S. Provisional Application No. 61/383,696 which was filed on Sep. 16, 2010 and which is incorporated herein by reference in its entirety.

BACKGROUND

The systems and techniques disclosed herein relate to digital data processing and, in particular, to providing data associated with social media websites.

Various social media websites allow people to post content that is viewable over the web by others. Example social media websites include web blogs, microblogs, social networking, podcasts, photo sharing websites, video sharing websites, and so on. A user can have accounts with multiple social media websites.

SUMMARY

This document describes systems and techniques for displaying information associated with multiple accounts of multiple social media websites owned by an owner. For example, a user can access a webpage at a social media website that is associated with an account owned by another user (referred to as the owner). An example webpage can be the owner's blog. Based on data obtained from the social media webpage, other webpages can be identified that are associated with accounts owned by the owner for other social media websites, such as the owner's microblog webpage, the owner's photo sharing webpage, the owner's social networking webpage, etc. These other webpages can be associated with separate websites independent from the website that hosts the owner's blog.

As the owner's blog is displayed, data associated with the other webpages can be displayed with the blog. In one such example, links to the other social media webpages for which the owner has accounts can be displayed along with the social media webpage accessed by the user, such as on a toolbar, a side window, or in a pop-out window. In some examples, data associated with the owner's microblog, such as a most recent broadcast message, can be displayed; data associated with the owner's photo sharing webpage, such as a most recently displayed photo, can be displayed; and/or data associated with the owner's social networking webpage, such as a recent post, can be displayed.

Also, when the user accesses the social media webpage associated with an account owned by the owner, people connected to the owner through other social media websites with which the owner has accounts can be identified and displayed. In addition, people connected to the user accessing the social media webpage can be identified, such as through various social media websites for which the user has accounts. And, a comparison can be made between the people connected to the user and the people connected to the owner to determine common connections. If commonly connected people are identified, information regarding such common connections can be displayed when the webpage accessed by the user is displayed. Also, when the webpage of the owner is accessed by the user, a common social media website with which both the owner and the user have an account can be identified. The user can be presented with the option to connect with the owner through the common social media website.

One aspect of the subject matter described in this specification can be embodied in methods that include the actions of determining that a webpage accessed by a user is a webpage of a social media website; obtaining data from the accessed webpage identifiable with an owner of an account of the social media website in which the owner of the account is not the user; based at least on the data from the accessed webpage identifiable with the owner, identifying another social media webpage associated with another account of the owner for another social media website; obtaining data associated with the other social media webpage; and providing the data associated with the other account for display with the accessed webpage in response to the determining.

Other embodiments of this aspect include corresponding systems, apparatus, and computer programs, configured to perform the actions of the methods, encoded on computer storage devices.

These and other embodiments can each optionally include one or more of the following features. The actions can further include determining that the user has an account for the other social media website; and providing for display with the accessed webpage an option to the user to connect with the owner through the other social media website. Determining that the user has the account for the other social media website can include determining that the user is logged on to the user's account for the other social media website. The data associated with the other account can include data identifying a Uniform Resource Locator (URL) for the other social media webpage for the other account; and providing the data associated with the other social media webpage for display with the accessed webpage can include providing for display a selectable link for the URL. Obtaining the data associated with the other social media webpage include obtaining, from a server system for the other social media website, data posted to the other social media website; and providing the data associated with the other social media webpage for display with the accessed webpage includes providing for display with the accessed webpage the data posted to the other social media website. The data posted to the other social media website can include an image. The data posted to the other social media website can include a message from the owner. The actions can further include obtaining data about people linked to the user; wherein obtaining data associated with the other social media webpage includes obtaining data about people linked to the owner through the other social media website; and providing for display data about common people linked to the owner and to the user.

One aspect of the subject matter described in this specification can be embodied in a system that includes a computing device including a processor; a program for rendering web-based content; and when performed by the processor, the program configured to: determine that web content displayed by the computerized device is from a social media website; obtain data from the web content identifiable with an owner of an account for the social media website; provide the obtained data to a server system for identifying another social media webpage associated with another account of the owner for another, different social media website based on the obtained data from the web content; receive data associated with the other social media webpage; and display the received data with the displayed web content in response to the determination.

One or more of the following features can optionally be included. The program is further configured to display the received data without obscuring the display of the web content. The received data includes data posted to the other social media website. The data can include a Uniform Resource Locator (URL) for the other social media webpage for the other account of the owner of the other social media website.

The received data includes data regarding a common connection between the user and the owner. The displayed data allows a user accessing the web content using the computing device to send a request for connecting to the owner through the other website.

Details of one or more implementations are set forth in the accompanying drawings and the description below. Other features, aspects, and potential advantages will be apparent from the description and drawings, and from the claims.

DESCRIPTION OF DRAWINGS

Like reference symbols in the various drawing indicate like elements.

DETAILED DESCRIPTION

Figure 1:
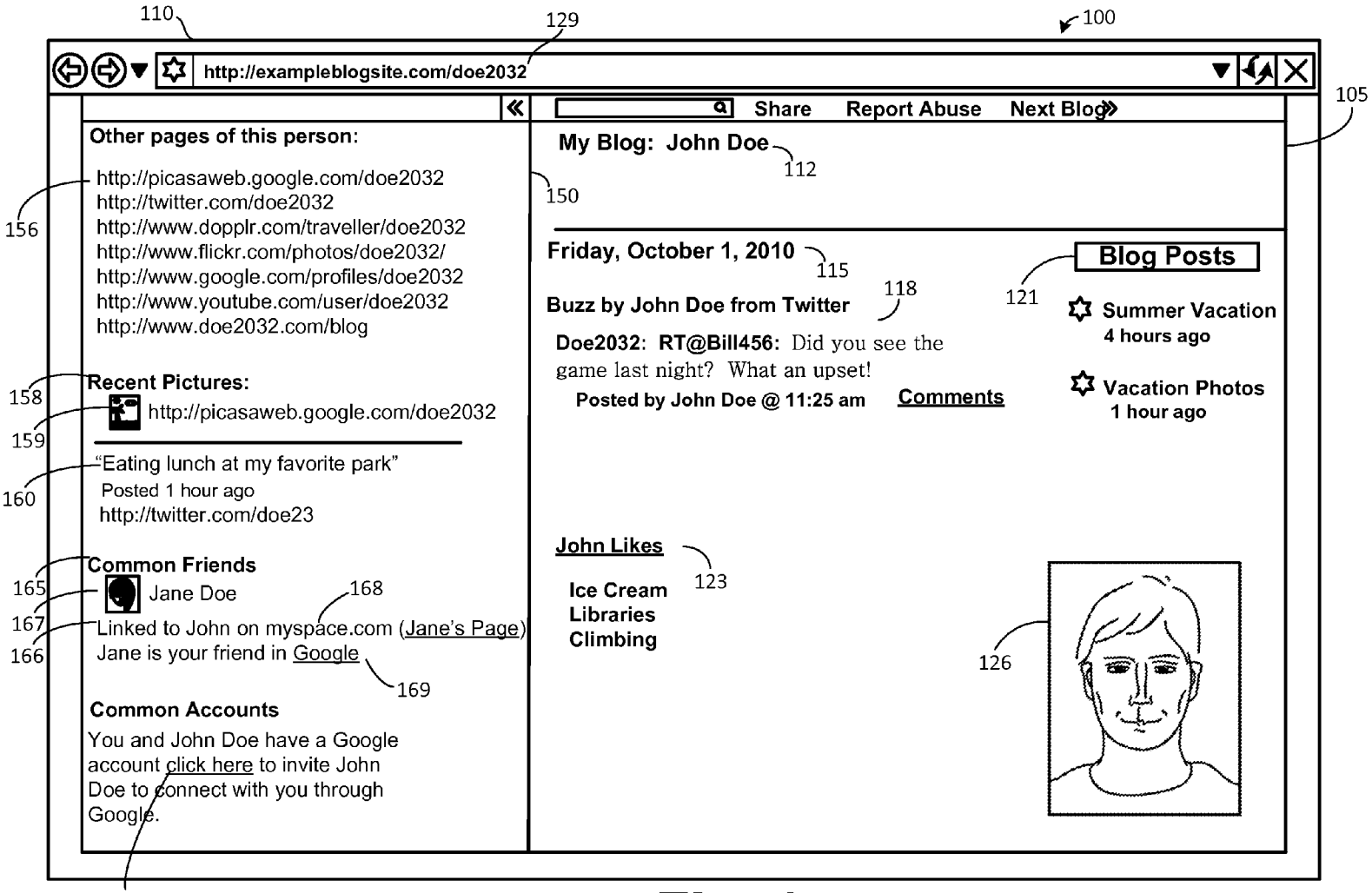
FIG. 1 illustrates an example graphical user interface for presenting content with a social media webpage.

FIG. 1 illustrates an example graphical user interface (GUI) 100 for presenting content with a social media webpage 105. In some implementations, the GUI 100 is configured to present, with the webpage 105, information associated with multiple accounts of multiple social media websites owned by an owner who also owns the account for the webpage 105. By way of illustration, a user account of a social media website is owned by the user who created the account. In the example shown, the social webpage 105 is a blog, the account of which is owned by an owner named John Doe. The blog has, for example, a title 112, a date 115, a posting by the owner 118, a list of past blog posts 121, a list of the owner's likes 123, and a picture of the owner 126.

The webpage 105 is presented in a browser 110. An address 129 of the webpage 105 is displayed in a text box 132 of the browser 110 as Uniform Resource Locator (URL). The webpage 105 can be displayed by any program that can render content from the World Wide Web. As can be seen from the address 129, the account owned by the owner, John Doe, associated with the webpage 105 is for a website titled "exampleblogsite.com."

When a user browses to the webpage 105 for the owner's blog, a window 150 can also be displayed in the browser 110 for presenting information associated with other accounts owned by John Doe of other social media websites (i.e. other than the exampleblogsite.com). The window 150 can be displayed in a manner so as not to interfere with the presentation of the webpage 105. In the example shown, the window 150 is a side window. Alternatively, the window 150 can be a pop-up or floating window, for instance.

A software program, such as a web browser plug-in module, can be used to identify that the website 105 being accessed by the web browser is a social media website. The program can send a request to a server system for information associated with other social media webpages for which the owner has an account and display that information in the window 150. In some examples, the server system can match information from the website 105, such as URL information, with data in a social graph that links the owner's social media websites. Website 105 is determined to be a social media website when a match is found between data from the website 105 and the social graph.

Based on information obtained as a result of the request, the window 150 displays at 156 other social media webpages that the owner maintains with other social media websites through accounts that he owns with those other social media websites. At 156 selectable links are presented for the other social media webpages so that the user can navigate to those other social media webpages. In the example shown, links to the owner's Picasa webpage, Twitter webpage, Dopplr webpage, Flickr webpage, Google profile, Youtube, and another blog are provided at 156.

In further implementations, recent posts to one or more of the owner's other social media webpages are presented at 158. For example, based on the request sent by the program, the server system can obtain data from the owner's other social media webpages and display that data in the side window 150. For example, at 158 an image 159 posted at the owner's Picasa social webpage is displayed with a link to that webpage. At 160, a recent post from the owner to his Twitter webpage is displayed with a link to that webpage.

In yet further implementations, information regarding common friends of the user browsing the webpage 105 and the owner of webpage 105 are displayed at 165. For example, the identity of the user browsing the webpage 105 can be determined. When the user is logged on to a user account, such as a Google account, the identity can be determined based on the user's account information. Identification information can be sent for the user and for the owner to a server system that identifies the friends of the user and the friends of the owner—the owner of the account associated with the webpage 105. Common friends can then be identified and displayed at 165. For example, a common friend, Jane Doe, was identified and information regarding the common connection is presented at 166. Also, information regarding the common friend, such as information from one or more of the common friend's social media websites, can be presented. In the example shown at 165, a picture 167 of the common friend is presented. Also, links to the common friend's social media webpages are provided at 168 and 169.

Also, one or more accounts of the user and the owner common to a social media website are identified in various implementations. In the example shown, it was identified that the user and the owner have accounts with a common social media website. The user is presented with a link 171 to invite owner to connect with him through the common social media website.

Figure 2:
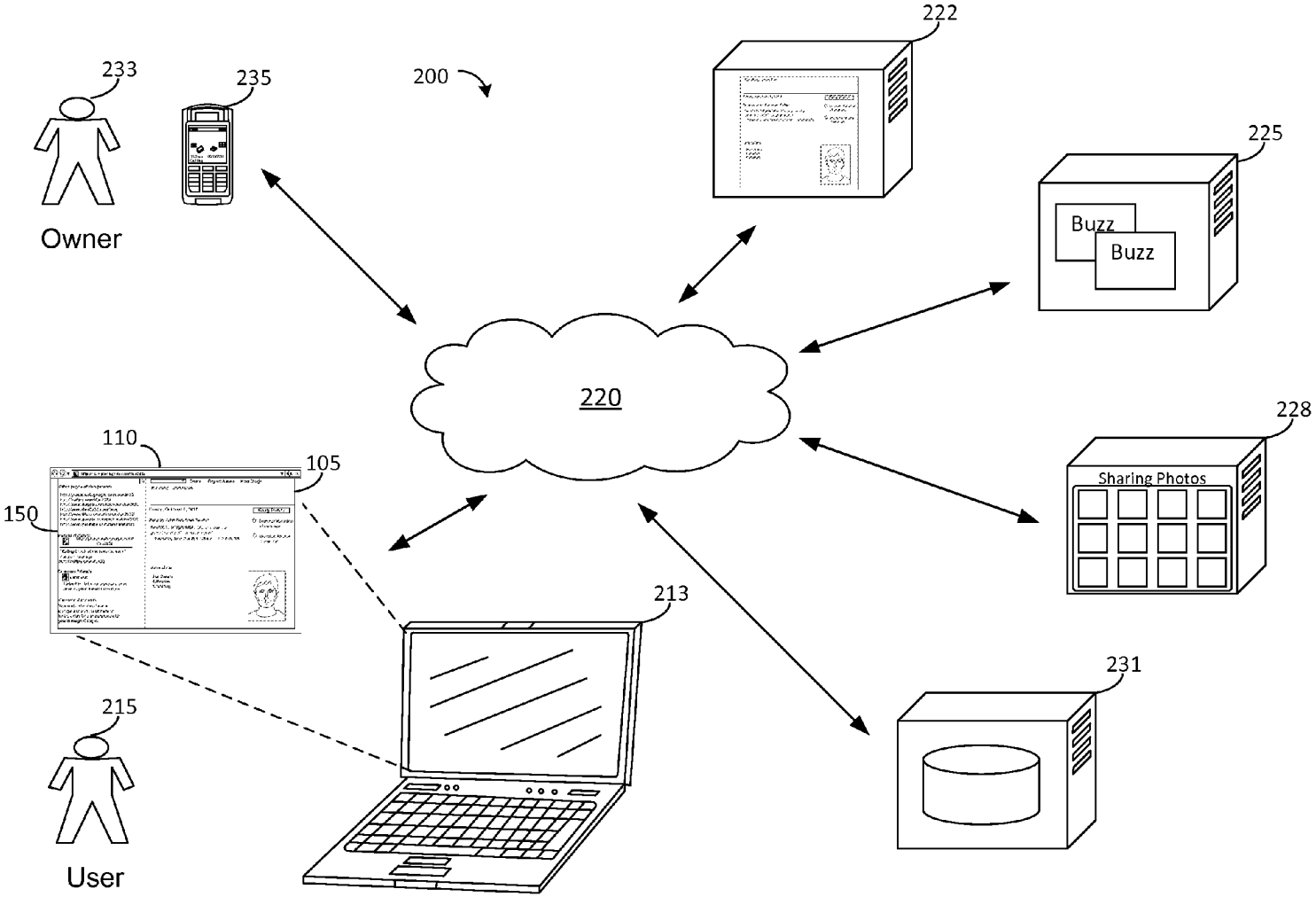
FIG. 2 shows an example system for providing social media information.

FIG. 2 shows an example system 200 for providing social media information. The system includes a first computing device 213 being used by a user 215. The computing device 213 is connected to a network 220, such as a wide area network (e.g., the Internet) providing the computing device 213 access to the World Wide Web. In the example shown, the user 215 is using the first computing device 213 to browse webpage 105 using the browser 110. The system 200 also includes a second computing device 235 such as a mobile phone with which owner 233, who owns the account associated with the webpage 105, can access the network 220.

The system 200 also includes multiple server systems also connected to the network 220. A server system can include one or more servers at one or more locations. A first server system 222 is associated with the social media website for the webpage 105 and stores data for presenting the webpage 105. The owner 233 has an account with the website for the webpage 105 and can update the webpage 105 over the network 220 using the second computing device 235.

A second server system 225 is another social media website server system for a social media website for sharing updates, such as Google Buzz (available from Google Inc. of Mountain View, Calif.), with which the user 215 has an account and with which the owner 233 has an account. A third server system 228 stores data for a photo sharing social media website. The owner 233 has an account with the photo sharing social media website.

A fourth server system 231 stores data obtained from multiple social media websites including data regarding webpages for the social media websites associated with the first, second, and third servers systems. The fourth server system 231 can have a web crawler to crawl social media websites and obtain data regarding publicly available social media webpages at those social media websites. The obtained data can include data regarding the owners of accounts associated with those websites, and regarding friends of those owners. For example, an owner of an account for a webpage associated with a social media website can be identified based on metadata or other information in the webpage. The owner's friends can also be identified based on metadata on the webpage designating a person listed as one of the owner's friends. Also, if the owner has posted links to other webpages for other social media websites on his webpage being crawled, the other webpages owned by the owner can be identified. The multiple other webpages of the owner can also be crawled. A social graph can be constructed using information gathered by crawling multiple webpages for multiple social media websites for multiple owners. The social graph information can be stored in the fourth server system 231. In some examples, processes can be provided that allow an owner to opt-in or opt-out of having social media data obtained.

When the user 215 browses to the social media webpage 105 for the owner 233, information identifiable with the owner, such as a URL or other metadata from the webpage, can be provided to the fourth server system 231 to identify other social media webpages for which the owner 233 has accounts, to identify friends of the owner 233, to identify common friends of the owner 233 and the user 215, and/or to identify common social media websites for which the user 215 and the owner 233 have accounts for social media webpages. Such social media information identified by the fourth server system can be provided to the first computing device 213 for display with the social media webpage 105 in side window 150.

Figure 3:
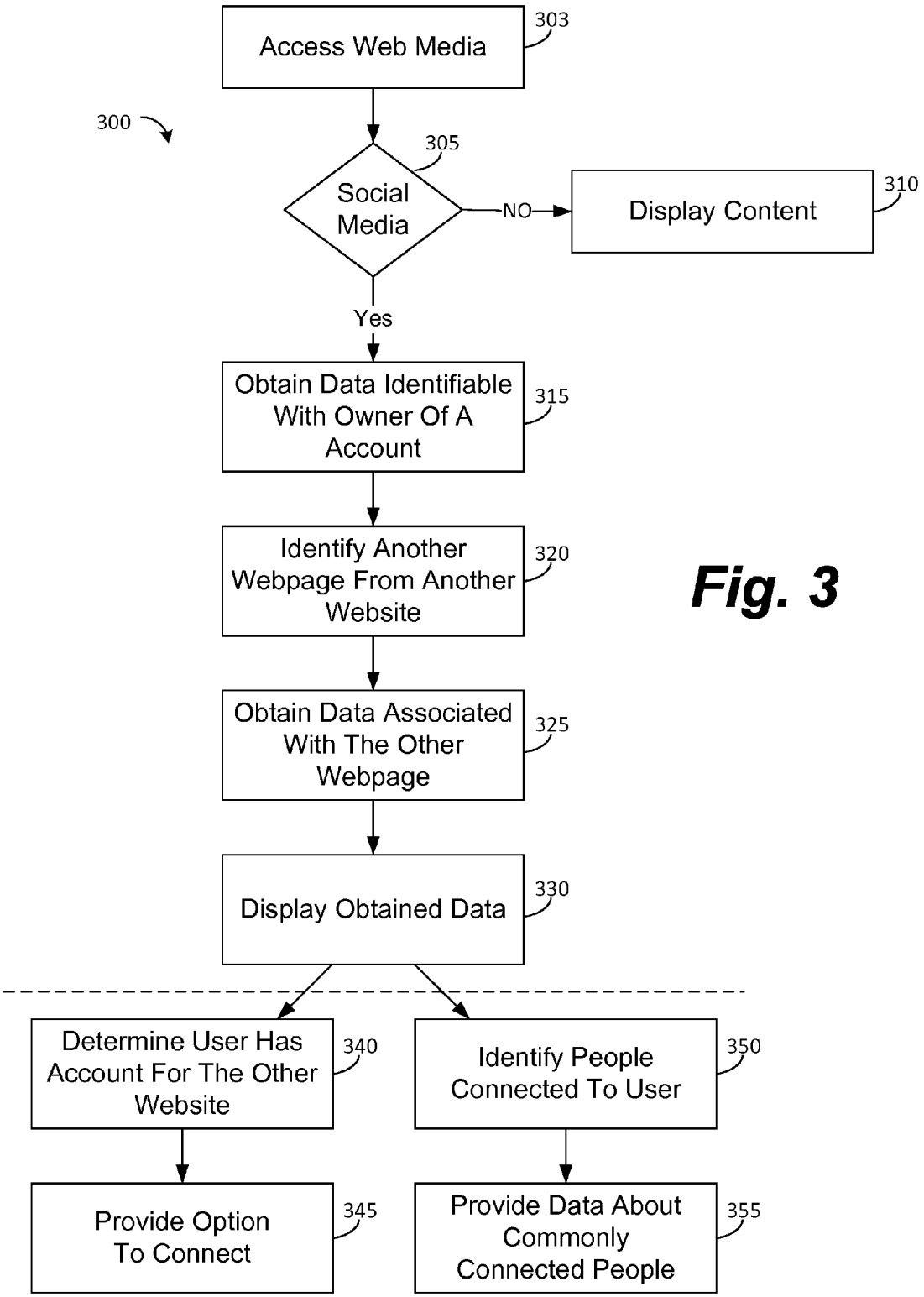
FIG. 3 shows an example process for providing social media information.

Also, when other social media webpages for the owner have been identified, information can be obtained from those other social media webpages for presentation in the window 150 such as recent posts to those other social media webpages. For example, a photo social media webpage of the owner 233 stored on the third server system can be identified and information regarding the photo sharing social media webpage such as link to the photo sharing social media webpage and/or a photo shared on the photo sharing social media webpage can be provided to the first computing device 213 for display in side window 150. Also, when a common friend has been identified, information can be obtained from a social media webpage for which the common friend has an account. The information obtained for the common friend, such as a photo, a recent post, etc., can be provided to the first computing device 213 for display. Also, in some examples, information can be obtained from a social media website for which the owner and user both have an account such as second server system 225. The information is used to provide a link to allow the user 215 to send a request to connect with the owner 233 from the side window 150. A request to connect can include for example, a link request, a friend request, a request to follow, etc. FIG. 3 shows an example process 300 for providing social media information. At 303, web-based media is accessed, for example, by a user. At 305, a determination is made regarding whether the accessed web-based media is and/or includes social media. For example, the web-based media can have an associated URL that can be used to identify that the media is social media. Also, web-based media can include social media such as an imbedded hyperlink to a social media webpage. Also, a URL and/or an imbedded hyperlink can have a metadata tag identifying the owner or an association (e.g. a friend of the owner) for the URL and/or hyperlink. If not, then at 310, the accessed media is presented.

If the web media is and/or includes social media, such as a social media webpage, then at 315 data is obtained from the social web media identifiable with an owner of a social media website account from which the social media was accessed. For different social media websites, there can be different predefined rules for parsing a web page's metadata in order to extract the relevant information. For example, data and/or metadata associated with the accessed web-based media can contain information regarding the owner of a social media account or regarding friends of the owner. In some examples, a link that contains a URL in the accessed social media can also be provided with metadata identifying the owner of an account associated with the link. Also, links to friends on a social media webpage can also include metadata identifying that the linked person is a friend (or other type of relationship) of the owner of the account associated with the webpage.

At 320, another social media webpage associated with another account of the owner for another social media website is identified. This can be accomplished by searching for the owner in a database or social network graph to find related accounts. Data regarding the other social media webpage such as URL data, recent posts of the owner to the website is obtained at 325. At 330, the obtained data is provided for display with display of the accessed social media. For example, a side window can be displayed with display of the social media such as a social media webpage for the owner.

Optionally, other social media information can be identified. For example, at 340 it can be determined that the user accessing the social media and the owner both have an account with the other social media website. At 345, an option to connect with the owner can be provided for display to the user with the display of the social media.

Also, at 350, common people connected to the user and the owner can be identified. For example, the user's identity can be known such as by being signed into a social media website. The identified user information can be used to obtain additional social media information from multiple other social media websites for the user, including social connections for the user. This can be accomplished by searching for the user in a database or social network graph to find related accounts and to find connections to the user through those accounts. Also, social media information can be obtained from a database or a social network graph regarding the owner's social connections based on information obtained from the accessed media. At 355, data regarding commonly connected people between the owner and the user can be provided for display to the user with the social media accessed by the user.

Figure 4:
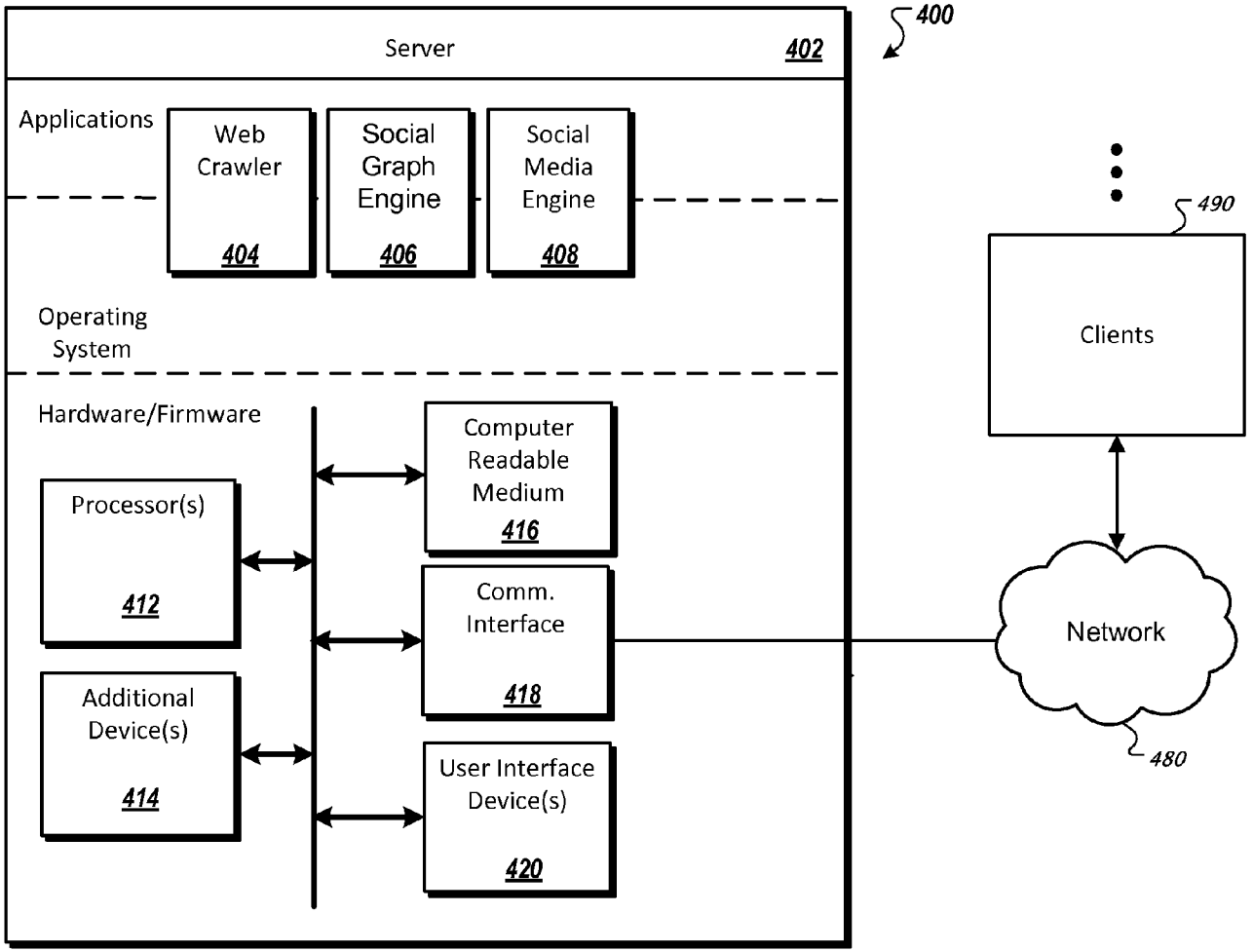
FIG. 4 is a schematic diagram of an example system configured to provide social media data for presentation with a webpage.

FIG. 4 is a schematic diagram of an example system 400 configured to provide social media data for presentation with a webpage. The system 400 generally consists of a server 402. The server 402 is optionally connected to one or more user or client computers 490 through a network 480. The server 402 consists of one or more data processing apparatus. While only one data processing apparatus is shown in FIG. 4, multiple data processing apparatus can be used in one or more locations.

The server 402 includes various modules, e.g. executable software programs, such as a web crawler engine 404 configured to obtain data from multiple social media websites and a social graph engine 406 configured to organize the data obtained by the web crawler engine into a social graph. Social media information can be obtained by the crawler by identifying metadata in web-based media such as tags or websites marked-up with identifiers identifying an owner of a social media webpage account, friends of the owner, etc. The social graph engine 406 can store social graph data on a computer readable medium 416.

The server 402 can also include a module such as a social media engine 408. The social media engine 408 is configured to identify an owner of an account of a webpage being displayed on one or more of the computers 490. The social media engine 408 can obtain social media data associated with other accounts of other social media websites owned by the owner from e.g. the social graph stored in the computer readable medium 416 and/or from other social media websites connected to network 480. The social media engine 408 can provide the obtained social media data for display with the webpage on the one or computers. For example, the social media engine 408 can obtain links of webpages for the other social media websites and/or data posted to the other social media websites and provide that data for display with the webpage on the one or more computers 490.

Also, the social media engine 408 can identify a user of the one or more of the computers 490 and, using the social graph, can identify common friends of the owner and the user 490. The common friend information can be provided to the one or more computers 490 for display with the webpage.

Also, the social media engine 408 can identify a social media website where both the owner and the user have an account. The social media engine can provide data for display with the webpage on the one or more computers for allowing the user to send a request to connect with the owner through social media website where the owner and the user have an account (e.g. through a social media website not associated with the webpage being displayed).

Each module runs as part of the operating system on the server 402, runs as an application on the server 402, or runs as part of the operating system and part of an application on the server 402, for instance. Although several software modules are illustrated, there may be fewer or more software modules. Moreover, the software modules can be distributed on one or more data processing apparatus connected by one or more networks or other suitable communication mediums.

The server 402 also includes hardware or firmware devices including one or more processors 412, one or more additional devices 414, a computer readable medium 416, a communication interface 418, and one or more user interface devices 420. Each processor 412 is capable of processing instructions for execution within the server 402. In some implementations, the processor 412 is a single or multi-threaded processor. Each processor 412 is capable of processing instructions stored on the computer readable medium 416 or on a storage device such as one of the additional devices 414. The server 402 uses its communication interface 418 to communicate with one or more computers 490, for example, over a network 480. Examples of user interface devices 420 include a display, a camera, a speaker, a microphone, a tactile feedback device, a keyboard, and a mouse. The server 402 can store instructions that implement operations associated with the modules described above, for example, on the computer readable medium 416 or one or more additional devices 414, for example, one or more of a floppy disk device, a hard disk device, an optical disk device, or a tape device.

A resource can be stored in a portion of an electronic file (e.g., a webpage or other document) that holds other resources, in a single electronic file dedicated to the resource in question, or in multiple coordinated electronic files. Moreover, a resource can be stored in a memory without having first been stored in file.

Implementations of the subject matter and the operations described in this specification can be implemented in digital electronic circuitry, or in computer software, firmware, or hardware, including the structures disclosed in this specification and their structural equivalents, or in combinations of one or more of them. Implementations of the subject matter described in this specification can be implemented as one or more computer programs, i.e., one or more modules of computer program instructions, encoded on computer storage medium for execution by, or to control the operation of, data processing apparatus. Alternatively or in addition, the program instructions can be encoded on an artificially-generated propagated signal, e.g., a machine-generated electrical, optical, or electromagnetic signal that is generated to encode information for transmission to suitable receiver apparatus for execution by a data processing apparatus. A computer storage medium can be, or be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially-generated propagated signal. The computer storage medium can also be, or be included in, one or more separate physical components or media (e.g., multiple CDs, disks, or other storage devices).

The operations described in this specification can be implemented as operations performed by a data processing apparatus on data stored on one or more computer-readable storage devices or received from other sources.

The term "data processing apparatus" encompasses all kinds of apparatus, devices, and machines for processing data, including by way of example a programmable processor, a computer, a system on a chip, or multiple ones, or combinations, of the foregoing The apparatus can include special purpose logic circuitry, e.g., an FPGA (field programmable gate array) or an ASIC (application-specific integrated circuit). The apparatus can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The apparatus and execution environment can realize various different computing model infrastructures, such as web services, distributed computing and grid computing infrastructures.

A computer program (also known as a program, software, software application, script, or code) can be written in any form of programming language, including compiled or interpreted languages, declarative or procedural languages, and it can be deployed in any form, including as a stand-alone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform actions by operating on input data and generating output. The processes and logic flows can also be performed by, and apparatus can also be implemented as, special purpose logic circuitry, e.g., an FPGA (field programmable gate array) or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for performing actions in accordance with instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device, e.g., a mobile telephone, a personal digital assistant (PDA), a mobile audio or video player, a game console, a Global Positioning System (GPS) receiver, or a portable storage device (e.g., a universal serial bus (USB) flash drive), to name just a few. Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, implementations of the subject matter described in this specification can be implemented on a computer having a display device, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending webpages to a web browser on a user's client device in response to requests received from the web browser.

Implementations of the subject matter described in this specification can be implemented in a computing system that includes a back-end component, e.g., as a data server, or that includes a middleware component, e.g., an application server, or that includes a front-end component, e.g., a client computer having a graphical user interface or a Web browser through which a user can interact with an implementation of the subject matter described in this specification, or any combination of one or more such back-end, middleware, or front-end components. The components of the system can be interconnected by any form or medium of digital data communication, e.g., a communication network. Examples of communication networks include a local area network ("LAN") and a wide area network ("WAN"), an inter-network (e.g., the Internet), and peer-to-peer networks (e.g., ad hoc peer-to-peer networks).

The computing system can include clients and servers. A client and server are generally remote from each other and typically interact through a communication network. The relationship of client and server arises by virtue of computer programs running on the respective computers and having a client-server relationship to each other. In some implementations, a server transmits data (e.g., an HTML page) to a client device (e.g., for purposes of displaying data to and receiving user input from a user interacting with the client device). Data generated at the client device (e.g., a result of the user interaction) can be received from the client device at the server.

While this specification contains many specific implementation details, these should not be construed as limitations on the scope of any implementations or of what may be claimed, but rather as descriptions of features specific to particular implementations of particular implementations. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

What is claimed is:

1. A computer-implemented method comprising:

identifying a particular social media website accessed by a user, the user associated with a first social graph based on one or more relationships between the user and one or more first contacts;

identifying one or more links associated with the particular social media website, the one or more links associated with one or more other social media websites, the one or more other social media websites associated with an owner of the social media website;

obtaining data from the one or more other social media websites, the data being associated with the owner;

identifying, based on the data from the one or more other social media websites, one or more second contacts that are socially connected to the owner via the one or more other social media websites;

generating a second social graph for the owner, the second social graph based on one or more relationships between the owner and the one or more second contacts;

comparing the second social graph of the owner with the first social graph of the user;

identifying, based on the comparing, a common contact that is socially connected to both i) the owner only through a first social media website of the one or more other social media websites and to ii) the user only through a second social media website of the one or more other social media websites, the first social media website being different than the second social media website, and the first and the second social media websites being different than the particular social media website;

obtaining social media data from the first and the second social media website that is associated with the common contact; and providing for display with the accessed webpage i) the social media data from the first social media website that is associated with the common contact and a link to the first social media website and ii) the social media data from the second social media website including a posted message that is associated with the common contact and a link to the second social media website.

2. The method of claim 1, further comprising:

determining that the user is associated with at least one of the one or more other social media websites; and providing for display with the accessed webpage an option for the user to connect with the owner through the at least one of the one or more other social media websites.

3. The method of claim 2, wherein determining that the user is associated with the at least one of the one or more other social media websites comprises determining that the user is logged into an account associated with the user for the at least one of the one or more other social media websites.

4. The method of claim 1, further comprising obtaining, from one or more server systems, data posted to the one or more other social media websites; and wherein providing for display with the accessed webpage comprises providing for display with the accessed webpage the data posted to the one or more other social media websites.

5. The method of claim 4, wherein the data posted to the one or more other social media websites comprises an image.

6. The method of claim 4, wherein the data posted to the one or more other social media websites comprises a message from the owner.

7. A non-transitory computer-readable medium encoding a computer program product operable to cause data processing apparatus to perform operations comprising:

identifying a particular social media website accessed by a user, the user associated with a first social graph based on one or more relationships between the user and one or more first contacts;

identifying one or more links associated with the particular social media website, the one or more links associated with one or more other social media websites, the one or more other social media websites associated with an owner of the social media website;

obtaining data from the one or more other social media websites, the data being associated with the owner;

identifying, based on the data from the one or more other social media websites, one or more second contacts that are socially connected to the owner via the one or more other social media websites;

generating a second social graph for the owner, the second social graph based on one or more relationships between the owner and the one or more second contacts;

comparing the second social graph of the owner with the first social graph of the user;

identifying, based on the comparing, a common contact that is socially connected to i) the owner only through a first social media website of the one or more other social media websites and to ii) the user only through a second social media website of the one or more other social media websites, the first social media website being different than the second social media website, and the first and the second social media websites being different than the particular social media website;

obtaining social media data from the first and the second social media website that is associated with the common contact; and providing for display with the accessed webpage i) the social media data from the first social media website that is associated with the common contact and a link to the first social media website and ii) the social media data from the second social media website including a posted message that is associated with the common contact and a link to the second social media website.

8. The computer-readable medium of claim 7, the operations further comprising:

determining that the user is associated with at least one of the one or more other social media websites; and providing for display with the accessed webpage an option for the user to connect with the owner through the at least one of the one or more other social media websites.

9. The computer-readable medium of claim 8, wherein determining that the user is associated with the at least one of the one or more other social media websites comprises determining that the user is logged into an account associated with the user for the at least one of the one or more other social media websites.

10. The computer-readable medium of claim 7, further comprising obtaining, from one or more server systems, data posted to the one or more other social media websites; and wherein providing for display with the accessed webpage comprises providing for display with the accessed webpage the data posted to the one or more other social media websites.

11. The computer-readable medium of claim 10, wherein the data posted to the one or more other social media websites comprises an image.

12. The computer-readable medium of claim 10, wherein the data posted to the one or more other social media websites comprises a message from the owner.

13. A system comprising:

a computing device including a processor;

a program for rendering web-based content; and when performed by the processor, the program configured to:

identify a particular social media website accessed by a user, the user associated with a first social graph based on one or more relationships between the user and one or more first contacts;

identify one or more links associated with the particular social media website, the one or more links associated with one or more other social media websites, the one or more other social media websites associated with an owner of the social media website;

obtain data from the one or more other social media websites, the data being associated with the owner;

identify, based on the data from the one or more other social media websites, one or more second contacts that are socially connected to the owner via the one or more other social media websites;

generating a second social graph for the owner, the second social graph based on one or more relationships between the owner and the one or more second contacts;

compare the second social graph of the owner with the first social graph of the user;

identify, based on the comparing, a common contact that is socially connected to i) the owner only through a first social media website of the one or more other social media websites and to ii) the user only through a second social media website of the one or more other social media websites, the first social media website being different than the second social media website, and the first and the second social media websites being different than the particular social media website;

obtain social media data from the first and the second social media website that is associated with the common contact; and display with the accessed webpage i) the social media data from the first social media website that is associated with the common contact and a link to the first social media website and ii) the social media data from the second social media website including a posted message that is associated with the common contact and a link to the second social media website.

14. The system of claim 13, wherein the program is further configured to display the social media data without obscuring the accessed web page.

15. The system of claim 13, wherein the data comprises data posted to the one or more other social media websites.

16. The system of claim 13, wherein the social media data further comprises information that allows the user to send a request for connecting to the owner through the first social media website.

* * * * *